US011420243B2

(12) United States Patent
Frauenhuber et al.

(10) Patent No.: US 11,420,243 B2
(45) Date of Patent: Aug. 23, 2022

(54) DEVICE FOR GUIDING METAL STRIPS WITH WEAR BODIES IN A FINISHING TRAIN

(71) Applicant: Primetals Technologies Austria GmbH, Linz (AT)

(72) Inventors: Klaus Frauenhuber, Linz (AT); Walter Grabner, Neuhofen an der Krems (AT); Friedrich Moser, Hellmonsoedt (AT); Juergen Schiefer, Allhaming (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 156 days.

(21) Appl. No.: 16/616,567

(22) PCT Filed: May 29, 2018

(86) PCT No.: PCT/EP2018/064064
§ 371 (c)(1),
(2) Date: Nov. 25, 2019

(87) PCT Pub. No.: WO2018/219946
PCT Pub. Date: Dec. 6, 2018

(65) Prior Publication Data

US 2021/0162477 A1 Jun. 3, 2021

(30) Foreign Application Priority Data

Jun. 2, 2017 (EP) ..... 17174195

(51) Int. Cl.

| | |
|---|---|
| ***B21B 39/14*** | (2006.01) |
| ***B21B 1/24*** | (2006.01) |
| ***B21B 13/02*** | (2006.01) |

(52) U.S. Cl.
CPC ..... *B21B 39/14* (2013.01); *B21B 1/24* (2013.01); *B21B 13/02* (2013.01)

(58) Field of Classification Search
CPC ..... B21B 37/50; B21B 39/084; B21B 41/10; B21B 39/008; B21B 39/10; B21B 39/02; B21B 39/04; B21B 39/14; B21B 39/16
(Continued)

(56) References Cited

U.S. PATENT DOCUMENTS

| | | | |
|---|---|---|---|
| 2,818,954 | A | 1/1958 | Vice |
| 9,694,403 | B2 | 7/2017 | Eckerstorfer |

(Continued)

FOREIGN PATENT DOCUMENTS

| | | | |
|---|---|---|---|
| CN | 1635935 | A | 7/2005 |
| CN | 101954384 | A | 1/2011 |

(Continued)

OTHER PUBLICATIONS

Frauenhuber, Translation of EP-2853315-A1 (Year: 2015).*

(Continued)

*Primary Examiner* — Jessica Cahill
*Assistant Examiner* — Bobby Yeonjin Kim
(74) *Attorney, Agent, or Firm* — Ostrolenk Faber LLP

(57) ABSTRACT

A device for laterally guiding a metal strip (1, 13) running over a loop lifter (4, 12) between two roll stands (2, 3, 8, 9) of a finishing train. The device includes at least one main member module (14) extending in a direction between the roll stands. The module has a guiding plane (15), and also supports a number of wear members (18, 19, 20), each with a wear surface (21, 22, 23). Those wear members can be turned to a number of rotational positions. At least two wear members (18, 19, 20) are respectively arranged between one of the roll stands (2, 3, 8, 9) and the loop lifter, wherein, seen in the direction of the loop lifter (4, 12), the surface area of (Continued)

the wear surface (21, 22, 23) of adjacent wear member bodies (18, 19, 20) increases. During the operation of the device, at least one of the wear members is rotated while the metal strip (1, 13) is running to expose another area of the wear surface to the side of the strip.

4 Claims, 2 Drawing Sheets

(58) Field of Classification Search
USPC ..... 72/250
See application file for complete search history.

(56) References Cited

U.S. PATENT DOCUMENTS

| | | | | |
|---|---|---|---|---|
| 10,376,938 | B2 | 8/2019 | Frauenhuber et al. | |
| 2005/0034500 | A1 | 2/2005 | Van Der Winden | 72/250 |

FOREIGN PATENT DOCUMENTS

| | | | | | |
|---|---|---|---|---|---|
| CN | 208991450 | U | | 6/2019 | |
| EP | 2 283 941 | A1 | | 2/2011 | |
| EP | 2853315 | A1 | * | 4/2015 | B21B 39/14 |
| EP | 2 905 089 | A1 | | 8/2015 | |
| JP | S 5339241 | A | | 4/1978 | |
| JP | H 05261421 | A | | 10/1993 | |
| JP | H10-005 842 | A | | 1/1998 | |
| JP | 2002224730 | A | | 8/2002 | |
| JP | 2002224730 | A | * | 8/2002 | B21B 39/14 |
| JP | 2003230908 | A | | 8/2003 | |
| KR | 20040087753 | A | | 10/2004 | |
| KR | 2006003 8290 | A | | 5/2006 | |
| KR | 20110130680 | A | | 12/2011 | |
| KR | 20130038263 | A | | 4/2013 | |
| KR | 20130120926 | A | | 11/2013 | |
| KR | 101690963 | B1 | | 1/2017 | |
| SU | 1069896 | A1 | | 1/1984 | |
| SU | 1560345 | A1 | | 4/1990 | |
| TW | M577769 | U | | 5/2019 | |
| WO | WO 2015/043926 | A1 | | 4/2015 | |

OTHER PUBLICATIONS

Egawa, Translation of JP-2002224730-A (Year: 2002).*

Japanese Office Action, dated Jun. 8, 2020, issue in corresponding Japanese Patent Application No. 2019-566158. English translation. Total 9 pages.

International Search Report dated Jul. 9, 2018 in corresponding PCT International Application No. PCT/EP2018/064064.

Written Opinion dated Jul. 9, 2018 in corresponding PCT International Application No. PCT/EP2018/064064.

Chinese Office Action, dated Dec. 9, 2020, issued in corresponding Chinese Patent Application No. 201810556678.6. English translation. Total 12 pages.

Russian Office Action dated Feb. 14, 2020 issued in corresponding Russian Patent Application No. 2017P00175WORU without English translation.

Korean Office Action dated Feb. 26, 2020 issued in corresponding Korean Patent Application No. 10-2019-7035118 with English translation.

Taiwan Office Action and Search Report, dated Jun. 10, 2021, issued in corresponding Taiwanese Patent Application No. 107118410. Total 5 pages.

Chinese Notice of Allowance, dated Dec. 28, 2021, issued in corresponding Chinese Patent Application No. 201810556678.6. Partial English translation. Total 7 pages.

* cited by examiner

DEVICE FOR GUIDING METAL STRIPS WITH WEAR BODIES IN A FINISHING TRAIN

CROSS-REFERENCE TO RELATED APPLICATIONS

The present application is a 35 U.S.C. §§ 371 national phase conversion of PCT/EP2018/064064, filed May 29, 2018, the contents of which are incorporated herein by reference, which claims priority of European Patent Application No. 17174195.2 filed Jun. 2, 2017, the contents of which are incorporated by reference herein. The PCT International Application was published in the German language.

TECHNICAL FIELD

The present invention relates to a device for laterally guiding a metal strip that by way of different paths runs across a loop lifter and that is adjustable to various positions between two roll stands of a finishing train.

PRIOR ART

In the production of metal strips, after the strips roll in a reversing stand in a finishing train, the strips are continuously rolled in a plurality of roll stands. Roller tables with laminar cooling direct the strips to coiling devices where the metal strips are coiled. It is necessary for the metal strips to be subjected to lateral guidance in the finishing train in order for a centric infeed to the respective roll gap of the roll stands to be performed. Devices for lateral guiding are referred to as guide rulers. The edges of the running metal strip on which the devices for lateral guiding act cause wear on wear strips which are fastened to the guide rulers, or on wear faces of the wear strips, respectively.

For some material qualities, the metal strip edges are abraded. The abraded material can adhere to the guide rulers and generate so-called packs of deposits. Should the packs of deposit drop onto the metal strip, this can lead to surface defects on the metal strip. Therefore, the wear faces of the wear strips have to be regularly refurbished and cleaned, depending on the production schedule.

To minimize complexity, it is known to not always replace the entire wear strips of the guide rulers when refurbishing. The disclosure of WO2015043926A1 is incorporated by reference in the disclosure of the present application. For example, rotatable wear members which guide the metal strip are also present in a main member module having a guiding plane. According to WO2015043926A1, the wear members are rotatable in a controlled manner to a plurality of defined rotary positions. Once a first metal strip has passed through the metal strip conveyor device, and before a second metal strip runs into the metal strip conveyor device, the wear members are rotated in a controlled manner from a first defined rotary position to a second defined rotary position. The second metal strip does not run through the wear rut or groove that has been cut into the wear face of the wear member by the first metal strip. Instead, the second metal strip is guided over a region of the wear face that is being exposed to a metal strip for the first time, and the metal strip steadily cuts a new wear rut in the wear face.

The length of the metal strip is modified when the strip is rolling in the finishing train. So-called loop lifters are installed between the roll stands in the finishing train for regulating the strip tension in a simpler manner, or for maintaining the tension of the strip despite the modification of the strip length. The loop lifter comprises a roller with a horizontal rotation axis which is vertically adjustable. The metal strip is tensioned and guided by the loop lifter roller, also referred to as the looper roller, when the surface of the loop lifter roller is above the pass line of the finishing train. In order for a metal strip, that has been elongated and accelerated by rolls, to be kept tensioned, the loop lifter roller is moved upward out of the pass line as a function of the force generated by the metal strip and acting on the loop lifter roller. The further the rotation axis of the loop lifter roller is above the pass line, the greater is the strip infeed angle into the following roll gap, or the strip outfeed angle from the previous roll gap. In each case, the metal strip has another path between the two roll gaps. There should be lateral guidance of the metal strip at each strip infeed angle, or strip outfeed angle, or for each path, respectively.

Replacement or manual cleaning of the guiding wear faces in the region of the loop lifters is very complex and dangerous, since there is little available space in the region of the stand and high temperatures prevail on account of the metal strip rolling at a temperature of approx. 1100° C. Such replacement or manual cleaning of the guiding wear faces can consequently only be performed during stoppages of the finishing train.

SUMMARY OF THE INVENTION

Technical Object

It is the object of the present invention to propose a finishing train, devices, and a method for operating the devices, wherein during lateral guiding of a metal strip that is guided by loop lifters in a finishing train, the complexity and the frequency of the requirement of replacing worn parts, or cleaning of wear faces, respectively, is minimized for each strip infeed angle or strip outfeed angle, respectively.

Technical Achievement

This object is achieved by a finishing train having at least two roll stands and at least one loop lifter which is disposed between two neighboring roll stands. The loop lifter is adjustable to various preferably vertically set positions, and has at least one device for laterally guiding a metal strip that runs by the loop lifter between two of the roll stands on different paths.

The device for lateral guiding comprises at least one main member module having a substantially vertical guiding plane, and a plurality of wear members, which are rotatable to a plurality of rotary positions. Each wear member has a wear face. The wear faces of the wear members are substantially planar. In all of their rotary positions, the wear faces are substantially parallel to a guiding plane of the main member module. In one embodiment at all rotary positions of the wear members, the wear members are substantially parallel to the guiding plane. At least two wear members are in each case disposed between one of the roll stands and the loop lifter, wherein the surface area of the wear faces of neighboring wear members increases when the wear members are viewed in the direction toward the loop lifter.

The finishing train has at least two roll stands. At least one loop lifter is disposed between two neighboring roll stands, when viewed in the running direction of the strip. When there are more than two roll stands, at least one loop lifter can also be repeatedly present between any two neighboring roll stands. Neighboring herein is to be understood to mean closest to one another. For example, when three roll stands A, B, C are present, one loop lifter can be present between neighboring stands A and B, and one loop lifter can be present between neighboring stands B and C. In the running direction of the strip, A and B are neighboring stands and B and C are neighboring stands, but A and C are not neighboring stands.

At least one device for lateral guiding is present in the finishing train. That device guides the metal strip that runs past the loop lifter and between the two neighboring roll stands. The device for lateral guiding in each case has at least two wear members between one of the two neighboring roll stands and the loop lifter between the two neighboring roll stands. The surface area of the wear faces of neighboring wear members increases from one wear member to another wear member, when they are viewed in the direction of the loop lifter. As a result, for neighboring wear members, the wear member that is situated closer to the loop lifter is of larger area than the wear member which is more remote from the loop lifter. Neighboring herein means closest to each other.

The metal strip is a steel strip or an aluminum strip, for example.

The main member module 14 has a guiding plane, for example, a so-called guide ruler, which has a face suitable for guiding the metal strip. That face is the guiding plane. The guiding plane can be formed by one, or a plurality, of wear plate(s) fastened to a support member. The support member and the wear plate(s) in this instance conjointly form the main member module. The device for lateral guiding may comprise one main member module or a plurality of the main member modules, for example, two main member modules, with each module for guiding one side of the metal strip. The guiding plane laterally guides the metal strip by contact with the sides of the metal strip.

The guiding plane restricts the freedom of movement of the metal strip in the direction of the guiding plane, which causes the metal strip to be laterally guided.

The main member module extends in a direction toward the loop lifter and also extends in a direction toward the roll stand.

The guiding plane is aligned to be substantially vertical. In addition to the main member module, the device for lateral guiding also comprises a plurality of wear members each having a wear face. A wear member is subjected to wear, as a result of guiding the metal strip, specifically in a region of the wear member referred to as the wear face. The wear member is a component different than the main member module, but it may be inserted in or at the main member module or may be fastened thereto, respectively. The wear member possesses at least one wear face. When it is guiding the metal strip, the wear face faces the metal strip and in the course of laterally guiding the metal strip, the wear face wears on account of its contact with the metal strip. The metal strip cuts into the wear face of the wear member and thus causes wear of the latter.

In its non-worn state, the wear face is substantially planar. The wear face is the region of the wear member that in operation guides the metal strip. This can be a face before the face is used for guiding and before it becomes worn. This can also be a face which has already been abraded on account of wear that has previously taken place but is again used for guiding. Of course, the wear member can also have regions which in operation do not come into contact with the metal strip, for example by virtue of the distance of the regions from the pass line of the finishing train.

The wording "substantially" is to imply that minor deviations from the required properties of planar, vertical, parallel, are acceptable. For example, deviations in relation to parallel or vertical, respectively, of up to 5°, preferably of up to 2°.

The wear member can be round or have other contours.

The wear member is rotatable to a plurality of rotary positions, particularly at least two rotary positions. The operator is able to choose between the rotary positions and to correspondingly control the rotation in an open-loop and/or closed-loop manner. This includes each wear member successively assuming a multiplicity of rotary positions while the wear member is rotated. The wear member may be fixed in a desired rotary position which the wear member has reached by rotation, or else may be rotated to a further rotary position by further rotation. The rotation herein can also be performed very slowly, for example one revolution in 12 hours or a multiplicity of rotary positions are successively assumed in the 12 hours.

A loop lifter is present between two roll stands of the finishing train. There are at least two wear members between a roll stand and the loop lifter in the device for lateral guiding.

The surface area of the wear faces of neighboring wear members increases in the direction of the loop lifter. For example, if three wear members are disposed between a roll stand and a loop lifter that follows in the running direction of the strip, the wear member that is a direct neighbor of the roll stand has the smallest area of the three wear members, and the wear member that is a direct neighbor of the loop lifter has the largest area. The central wear member has a larger area than its neighbor that directly neighbors the roll stand and has a smaller area than its neighbor that directly neighbors the loop lifter. If these are round (circular) wear members, the wear member directly neighboring the roll stand will thus have the smallest diameter, the wear member directly neighboring the loop lifter will have the largest diameter, and the wear member disposed therebetween will have an intermediate diameter.

For example, the loop lifter is controlled in a closed-loop manner by pressure or force and is adjustable to various positions During operation of the finishing train, that loop lifter is situated in various positions, depending on the properties of the metal strip. For each position of the loop lifter, another path results for the metal strip between a roll stand and the directly neighboring loop lifter. The strip infeed angle and the strip outfeed angle, respectively, are in each case different. The strip infeed angle and the strip outfeed angle, respectively, refer to the plane in which the roll gaps of the two roll stands lie. The metal strip exits the roll gap of the first roll stand (when viewed in the running direction of the strip), and runs on a path in the direction of the closest stand by way of the loop lifter roller where the metal strip is deflected. From there, the metal strip runs into the roll gap of the second, following roll stand (when viewed in the running direction of the strip).

Advantageous Effects of the Invention

A wear member is rotatable about a rotation axis. The rotation axis is preferably perpendicular to the wear face. The wear member is, particularly preferably, a round disk having a planar wear face which is formed by the base area of the disk.

To prevent wearing of a region of the wear face of the wear member exceeding an acceptable level, the wear member can be rotated, usually periodically, about the rotation axis. This brings another region of the wear member to face the edge of the metal strip and as a result of the edge guiding, the wear face is worn down by the edge. A requirement for replacing the wear face, or the wear member, respectively, can be delayed by multiple rotations of the wear member, since other regions are continuously brought to face the edge of the metal strip and the wear is therefore distributed uniformly across the wear face. The complexity of replacing worn parts is thus reduced, since a replacement of a wear member is required less frequently. Moreover, so-called packs of deposits should not accumulate at one location. Accordingly, the risk of those deposits dropping onto the metal strip is minimized. Moreover, existing packs of deposits can optionally also be abraded from the metal strip, again at another rotary position of the wear member.

From the roll stand and in the direction of the loop lifter, the metal strip repeatedly moves further away from the pass line of the finishing train. Another infeed angle and outfeed angle and thus another path are produced for each position of the loop lifter.

In a finishing train according to the invention, or by the device according to the invention, respectively, lateral guiding by wear plates is possible at each angle between the pass line of the finishing train and the metal strip. This is enabled because the wear plates have larger surface areas as their proximity to the loop lifter increases, and thus the wear plates can also provide lateral guiding as the distance of the metal strip from the pass line increases.

The wear members are preferably replaceable by simply replacing one in the event of its excessive wear. A replacement of the main member modules, or of parts of the main member modules, respectively, such as its wear members, for example, is comparatively more complex and is required less frequently since the lateral guiding by only the wear members is also sufficient. Since the wear members can be rotated to various rotary positions, a new region of the wear faces can be worn out again at all times. As a result, the wear can be distributed over the wear faces so that a replacement wear member is required less frequently. This reduces complexity and saves costs in terms of the maintenance of the device for lateral guiding.

According to one preferred embodiment, at least one wear member is capable of being disposed in a recess of at least one main member module. When the at least one wear member is disposed in a recess of the at least one main member module, it is possible for simultaneous guiding of the metal strip to be performed by both of the main member module and the wear member, for example when the wear face of the wear member does not protrude beyond the guiding plane of the main member module but at least in part lies in the guiding plane. This may be the case when the wear face is substantially planar, as is required according to the invention, and the wear faces lies parallel to the guiding plane, as parallel to the guiding plane also includes being in one plane with the guiding plane. When the wear face of the wear member does not protrude beyond the guiding plane of the main member module and does not lie in the guiding plane, but the wear face is further remote from the metal strip than the guiding plane of the main member module, specifically when the metal strip cuts so far into the main member module that the metal strip also comes into contact with the wear face and the strip is then guided by the main member module and the wear face of wear members guided on account thereof.

The recess is preferably round (circular). This enables simple rotating of a wear member that is disposed in the recess when the recess is rotationally symmetrical in relation to the rotation axis of the wear member. When the recess is not completely enclosed by the main member module, the periphery of the recess in the main member module in this embodiment follows part of a circle. The recess may also have other shapes.

Variants pertaining to an embodiment of wear members, which can optionally also be applied in the device according to the invention for lateral guiding of a metal strip that runs across a metal strip conveying device in a finishing train comprising at least one main member module having a substantially vertical guiding plane are disclosed in WO2015043926A1, which is incorporated by reference in the disclosure of the present application.

The wear members in the finishing train according to the invention are preferably disposed such that each path of the strip past the loop lifter leads across each wear face. Each path in part lies on each of the wear plates between the roll stand and the loop lifter. All wear members in this instance contribute to the lateral guiding independently of the spacing between the loop lifter roller and the pass line.

A further subject matter of the present invention is a device for laterally guiding a metal strip that run on different paths across a loop lifter and that is adjustable to various positions between two roll stands of a finishing train. That device comprises at least one main member module having a substantially vertical guiding plane, and a plurality of wear members which are rotatable to a plurality of rotary positions and which have a wear face, wherein the wear faces of the wear members, they are substantially planar and in all rotary positions are substantially parallel to the guiding plane. At least two wear members are disposed in at least one main member module, wherein the areas of the wear faces of neighboring wear members are of dissimilar sizes.

Such a device can be installed, for example, in a conventional finishing train to create a finishing train according to the invention. Or the device can be installed in a finishing train according to the invention to replace an already existing device according to the invention, or to increase the existing number of devices according to the invention in the finishing train.

It is preferable that the area of the wear face of directly neighboring wear members in a main member module, when viewed in the direction of a longitudinal extent of the main member module, increases from one wear member to another wear member.

A longitudinal extent of the main member module in the installed state between a roll stand and loop lifter for the operation in a finishing train is viewed from the loop lifter in the direction of the roll stand, or from the roll stand in the direction of the loop lifter, respectively, thus in the direction of or counter to the direction in which the metal strip to be laterally guided in operation runs through the finishing train. The main member module extends in a direction toward the roll stand and in a direction toward the loop lifter.

The wear members in the device according to the invention are preferably disposed such that each path of the strip past the loop lifter leads across each wear face. Each path in part lies on each of the wear plates between the roll stand and the loop lifter. All wear members in this instance contribute to the lateral guiding independently of the spacing between the loop lifter roller and the pass line.

In other words, a device according to the invention for laterally guiding a metal strip that, in the operation in a finishing train by different paths, runs across a loop lifter that is adjustable to various positions between two roll stands of a finishing train comprises at least one main member module having a substantially vertical guiding plane, and a plurality of wear members which are rotatable to a plurality of rotary positions and which have a wear face, wherein the wear faces of the wear members are substantially planar and in all rotary positions are substantially parallel to the guiding plane. At least two wear members are in each case disposed between one of the roll stands and the loop lifter, wherein the area of the wear face of neighboring wear members increases when viewed in the direction of the loop lifter, the wear members herein being preferably disposed such that each path leads across each wear face.

The device according to the invention is suitable for lateral guiding in a finishing train.

A further subject matter of the present invention is a method for operating a finishing train according to the invention or is a device according to the invention for lateral guiding, wherein at least one of the wear members is rotated while the metal strip is running.

The at least one wear member assumes a multiplicity of rotary positions during its rotation. The rotation herein can also be performed very slowly, for example by one revolution in 12 hours. The rotation can also be interrupted at intervals. On account of the rotation, wear of the wear members can be distributed uniformly across the wear face. This aids in extending the replacement intervals. The rotation can be performed to defined rotary positions, as disclosed in WO2015043926A1. The rotation can also be performed to non-defined rotary positions in terms of the rotation axis so that it is not predetermined by the operator that a specific rotary position is to be assumed at a specific point in time.

A different path of the metal strip occurs for each position of the loop lifter. The path followed by the metal strip is different, depending on the position of the loop lifter. Rotation takes place while the metal strip is running, preferably while lateral guiding by the rotated wear member is performed.

Lateral guiding by each wear member is preferably performed on each path followed by the metal strip and the guiding is variable in vertical position due to positioning of the loop lifter over which the strip passes. It thus applies to each path so that each in part lies on each of the wear faces between the roll stand and the loop lifter. All wear members in this instance contribute to the lateral guiding independently of the spacing between the loop lifter roller and the pass line.

BRIEF DESCRIPTION OF THE DRAWINGS

The present invention will be described in an exemplary manner hereunder by means of schematic figures in which.

DESCRIPTION OF THE EMBODIMENTS

Exemplars

Figure 1:
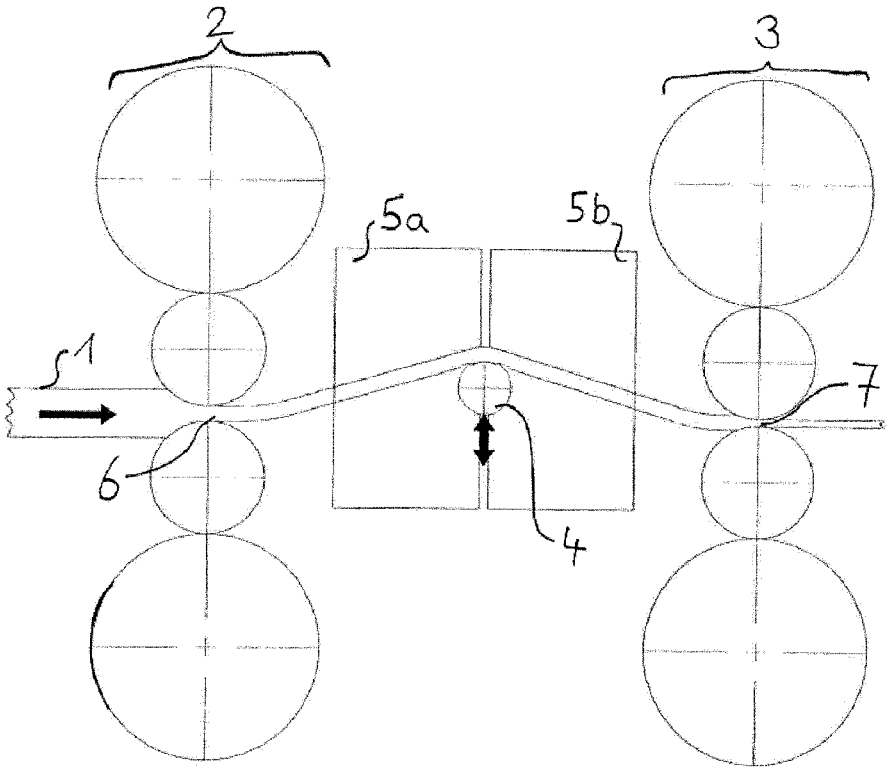
FIG. 1 schematically shows a conventional device for laterally guiding a metal strip running across a loop lifter between two roll stands of a finishing train.

FIG. 1 in a lateral view of a conventional device shows in fragments how a metal strip 1 runs in the direction indicated by an arrow runs across a loop lifter 4 between two roll stands 2, 3 of a finishing train in a conventional device. Plate-shaped wear strips 5*a*, 5*b* are present to the right and the left of the loop lifter 4 in order for the running metal strip 1 to be laterally guided. The loop lifter 4 is adjustable to various positions in height, which is illustrated by a double arrow. Depending on the position of the loop lifter, the metal strip 1 follows a different path from the roll gap 6 of the first roll stand 2 in the running direction of the strip into the roll gap 7 of the second roll stand 3 in the running direction of the strip. Only one path associated with the illustrated position of the loop lifter 4 is illustrated, but other paths of the loop lifter will occur as the loop lifter is adjusted vertically. The plate shaped wear strips are not rotatable.

Figure 2:
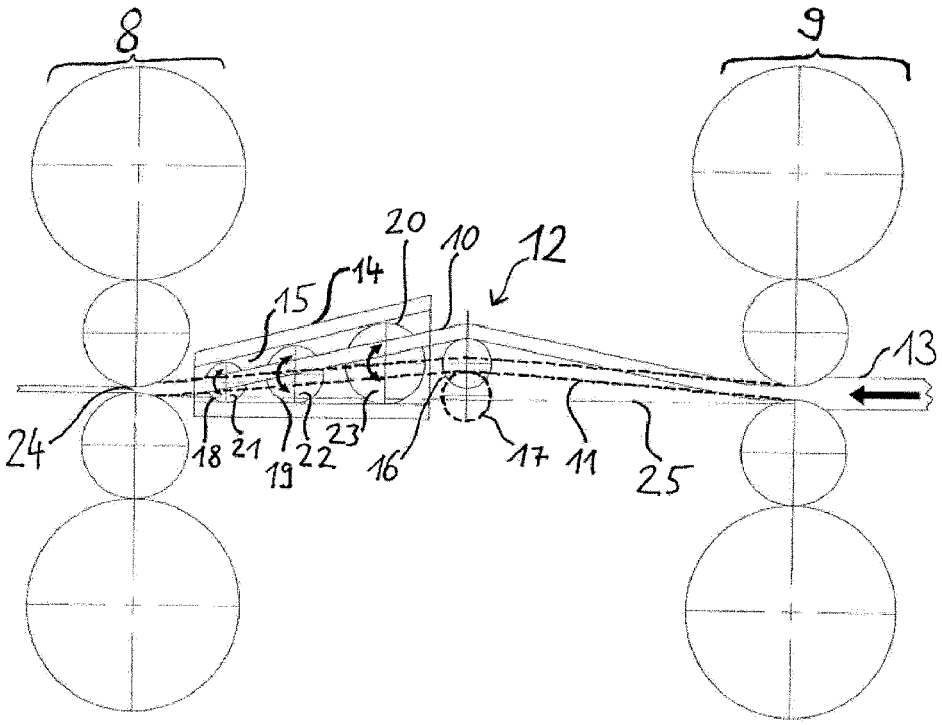
FIG. 2 schematically shows an embodiment of a device according to the invention as said device is in operation when installed in a finishing train according to the invention.

FIG. 2 shows a lateral view of a fragment of a finishing train according to the invention having an embodiment of a device according to the invention for lateral direction guiding of the metal strip, such as occurs when the device is installed in a finishing train according to the invention. A metal strip 13 runs on a respective different illustrated path 10 and 11 across a loop lifter 12 that is adjustable to various height positions between two roll stands 8, 9 of a finishing train. The running direction of the metal strip is from the roll stand 9 toward the roll stand 8 illustrated by an arrow.

A main member module 14 has a substantially vertical guiding plane 15 for guiding the module 14 toward an edge of the metal strip. The main member module 14 is disposed between the loop lifter 12 and the last roll stand 8 when viewed in the running direction of the strip. The main member module extends in a direction toward the roll stand and in a direction toward the loop lifter.

The loop lifter 12 across which the metal strip 13 runs can be set to various vertical positions. This is illustrated for two positions of the loop lifter roller by a solid outline 16 for one path and a dash outline 17 for the other path. The path 10 followed by the metal strip 13 across the topmost potential position of the loop lifter is illustrated with a solid lines. The path 11 followed across the lower potential position of the loop lifter is illustrated with a dashed line.

The device also comprises three rotatable wear members 18, 19, that are each individually rotatable to a plurality of rotary positions. The wear members may be at the main member module and may rotate there. The axially inward facing wear faces 21, 22, 23 of the wear members 18, 19, 20 are substantially planar and, in all of the rotary positions of the wear members, the wear faces are parallel to the guiding plane 15 of the main member module 14. The wear members may be at the main member module and may rotate there. The three wear members 18, 19, 20 are disposed between the loop lifter 12 and the last roll stand 8, when viewed in the running direction of the strip. When viewed from the roll gap 24 at the roll stand 8 in the direction of the loop lifter 12, the surface areas of the wear faces 21, 22, 23 of neighboring wear members 18, 19, 20 increase since the diameters of the three round wear members 18, 19, 20 increase. In the embodiment illustrated, each path of the strip, when it is at a selected vertical position, leads across each wear face 21, 22, 23. All wear members 18, 19, 20 contribute to the lateral guiding of the strip independently of the spacings illustrated between the loop lifter roller and the pass line 25, which pass line is illustrated by a dashed line. The wear members 18, 19, 20 are rotated during the operation of the plant illustrated, as illustrated by curved arrows Different rotation directions of the wear members are possible, while the metal strip 13 is running and is guided by the wear members 18, 19, 20. Illustration of parts for lateral guiding that are optionally present between the loop lifter 12 and the roll stand 9 are not shown for clarity. This can, for example, be an assembly that is mirror-symmetrical in relation to the assembly illustrated.

While the invention has been illustrated and described in more detail by way of the preferred exemplary embodiments, the invention is not limited by the disclosed exemplars and other variations can be derived therefrom by the person skilled in the art without departing from the scope of protection of the invention.

LIST OF REFERENCE SIGNS

1 Metal strip
2 Roll stand
3 Roll stand
4 Loop lifter
5*a*, 5*b* Wear strips
6 Roll gap
7 Roll gap
8 Roll stand
9 Roll stand
10 Path
11 Path
12 Loop lifter
13 Metal strip
14 Main member module
15 Guiding plane
16 Outline of loop lifter roller
17 Outline of loop lifter roller
18 Wear member
19 Wear member
20 Wear member
21 Wear face
22 Wear face
23 Wear face
24 Roll gap
25 Pass line

The invention claimed is:

1. A device for laterally guiding a metal strip that travels on different paths as the strip runs across a loop lifter;

the device comprising:

first and second roll stands spaced apart from each other and configured for directing the metal strip from the first roll stand and past the loop lifter to be guided on a path by the loop lifter and then to the second roll stand;

the loop lifter is located between the roll stands and is configured to be height-adjustable to a topmost vertical position and a lower vertical position;

the device comprising at least one main member module and the module having a substantially vertical guiding plane;

the at least one main member module extending in a direction toward one of the roll stands and in a direction toward the loop lifter;

a plurality of wear members are arrayed in a direction from one of the roll stands toward the loop lifter;

each wear member is rotatable to a respective plurality of rotary positions thereof, each wear member having a wear face, wherein the wear faces of the wear members are substantially planar and are substantially parallel to the guiding plane of the main member module;

at least two of the wear members are disposed at the at least one main member module and surface areas of the wear faces of neighboring ones of the wear members are of dissimilar sizes;

with the loop lifter at the topmost vertical position, a path is defined for the metal strip that passes along each wear surface; and with the loop lifter at the lower vertical position, another path is defined for the metal strip that passes along each wear surface.

2. The device as claimed in claim 1, wherein the surface areas of the wear faces of directly neighboring ones of the wear members in the main member module increases from one wear member to another wear member, when viewed in the direction of a longitudinal extent of the main member module and toward the loop lifter.

3. The device as claimed in claim 1, wherein the wear members are disposed such that each path of the strip leads across each of the wear faces on a path of the strip between the roll stands.

4. The device as claimed in claim 1, wherein in all rotary positions of the wear members, the wear members are substantially parallel to the guiding plane.

* * * * *